US007198353B2

(12) United States Patent
Hart et al.

(10) Patent No.: US 7,198,353 B2
(45) Date of Patent: Apr. 3, 2007

(54) INTEGRATED BLACK AND COLORED INK PRINTHEADS

(75) Inventors: Brian C. Hart, Georgetown, KY (US); Colin G. Maher, Georgetown, KY (US); James H. Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 265 days.

(21) Appl. No.: 10/881,659

(22) Filed: Jun. 30, 2004

(65) Prior Publication Data

US 2006/0001698 A1 Jan. 5, 2006

(51) Int. Cl.
*B41J 2/14* (2006.01)
*B41J 2/05* (2006.01)

(52) U.S. Cl. ..... 347/47; 347/65

(58) Field of Classification Search ..... 347/47, 347/65

See application file for complete search history.

(56) References Cited

U.S. PATENT DOCUMENTS 4,066,491 A * 1/1978 Ruh et al. ..... 216/27
4,746,935 A * 5/1988 Allen ..... 347/98
4,812,859 A 3/1989 Chan et al.
5,030,971 A 7/1991 Drake et al.
5,208,605 A * 5/1993 Drake ..... 347/15
5,666,140 A 9/1997 Mitani et al.
6,137,502 A * 10/2000 Anderson et al. ..... 347/15
6,146,915 A * 11/2000 Pidwerbecki et al. ..... 438/21
6,267,468 B1 7/2001 Torgerson et al.
6,315,389 B1 11/2001 Torgerson et al.
6,328,405 B1 12/2001 Weber et al.
6,431,682 B1 * 8/2002 Osada et al. ..... 347/47
6,513,896 B1 2/2003 Kawamura
6,896,357 B2 * 5/2005 Murakami et al. ..... 347/43
6,959,979 B2 * 11/2005 Goin et al. ..... 347/40
2002/0039120 A1 * 4/2002 Otsuka et al. ..... 347/29
2004/0227786 A1 * 11/2004 Muraoka ..... 347/40

* cited by examiner

*Primary Examiner*—Manish S. Shah
*Assistant Examiner*—Rene Garcia, Jr.
(74) *Attorney, Agent, or Firm*—Luedeka, Neely & Graham

(57) ABSTRACT

An improved ink jet printhead and method therefor. The printhead includes a single semiconductor substrate with ink ejection devices and a nozzle plate adjacent to the semiconductor substrate, the nozzle plate with first ink ejection nozzles for ejecting first ink drops having a first volume and second ink ejection nozzles for ejecting second ink drops having a second volume different from the first volume, wherein the first volume is defined by first flow features of the printhead having a first thickness and the second volume is defined by second flow features having a second thickness that is different from the first thickness.

22 Claims, 4 Drawing Sheets

INTEGRATED BLACK AND COLORED INK PRINTHEADS

FIELD OF THE DISCLOSURE

The disclosure relates to micro-fluid ejection devices such as ink jet printheads and methods for making micro-fluid ejection devices.

BACKGROUND

Color inkjet printers typically have a printhead for black ink and a printhead for colored inks, typically inks in the colors cyan, magenta, and yellow. It is desired to integrate the black ink and the colored inks into a single printhead utilizing a single silicon chip or semiconductor substrate, since much of the cost of the printhead is attributable to the semiconductor substrate. This would also alleviate problems associated with alignment of the black and colored printheads.

One factor inhibiting the use of a single silicon chip for black ink and colored inks is the different drop size requirements associated with the inks. For example, black ink is most typically used for printing text and is typically provided in larger drops of from about 15 to about 35 nanograms (ng). Colored inks are most typically used for photo printing and the like and are typically provided in smaller drops of from about 1 to about 8 ng.

The presently disclosed embodiments advantageously enable the manufacture of a printhead having a single silicon chip to supply black ink and colored inks in different desired drops sizes.

SUMMARY OF THE EMBODIMENTS

With regard to the foregoing, one embodiment provides an ink jet printhead, such as for an ink jet printer. The printhead includes a single semiconductor substrate with ink ejection devices and a nozzle plate adjacent to the semiconductor substrate. The nozzle plate contains first ink ejection nozzles for ejecting first ink drops having a first volume and second ink ejection nozzles for ejecting second ink drops having a second volume different from the first volume. The first volume is defined by first flow features of the printhead having a first thickness and the second volume is defined by second flow features having a second thickness that is different from the first thickness.

The embodiments described herein enable manufacture of a printhead that can eject different volumes of ink, yet which is made using a single semiconductor substrate. This advantageously reduces manufacturing costs and avoids disadvantages associated with alignment of separate printheads. That is, the embodiments enable manufacture of a printhead that can eject black ink as well as colored inks, such as cyan, magenta, and yellow inks.

BRIEF DESCRIPTION OF THE DRAWINGS

Further advantages of the embodiments described herein can be better understood by reference to the detailed description when considered in conjunction with the figures, which are not to scale and which are provided to illustrate the principles of the disclosed embodiments. In the drawings, like reference numbers indicate like elements through the several views.

DETAILED DESCRIPTION OF THE EMBODIMENTS

The disclosure provides printheads having a single silicon chip for supplying black ink and colored inks, preferably cyan, magenta, and yellow inks, in different desired drops sizes.

Figure 1:
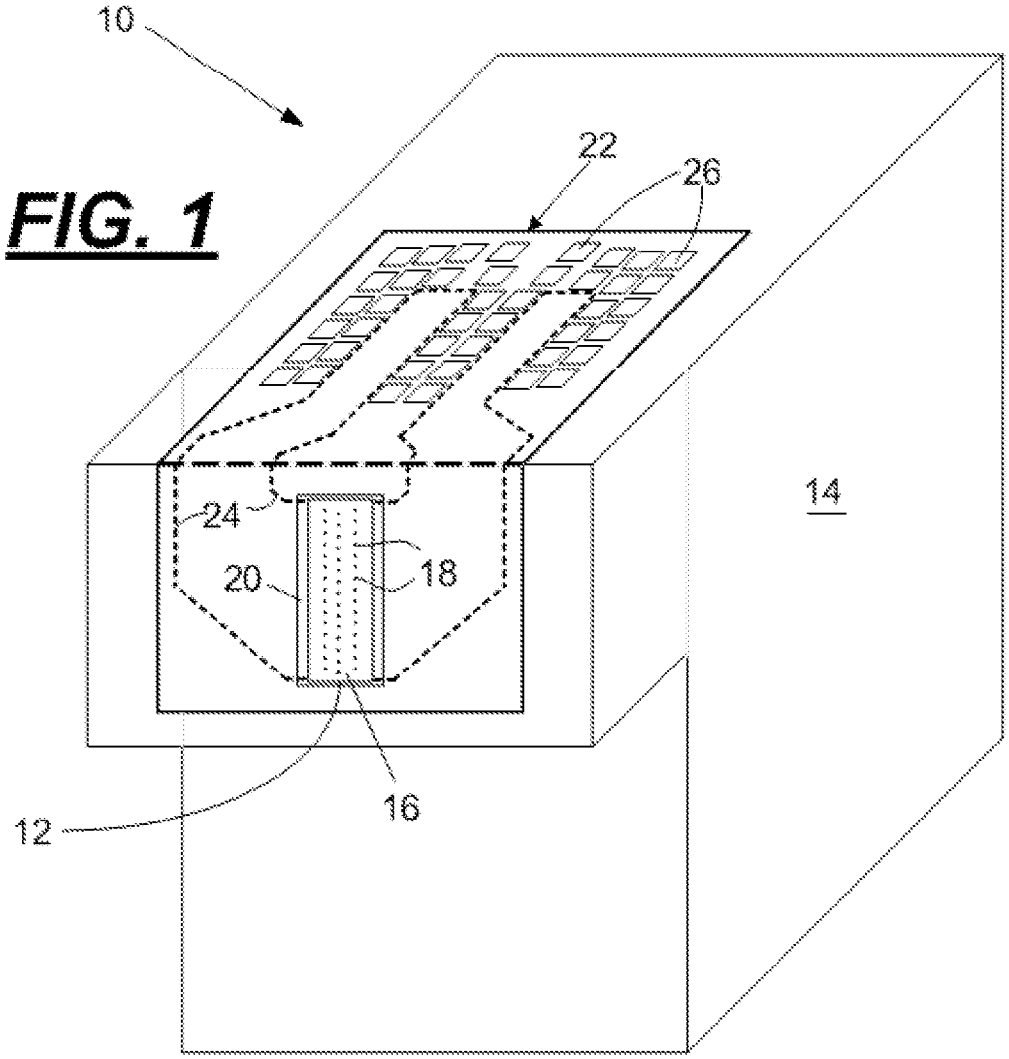
FIG. 1 is a perspective view, not to scale, of a fluid cartridge and micro-fluid ejection device according to an embodiment of the disclosure.

With reference to FIG. 1, there is shown a fluid supply cartridge 10 for use with a device such as an ink jet printer having a printhead 12 fixedly attached to a fluid supply container 14 as shown in FIG. 1 or removably attached to a fluid supply container either adjacent to the printhead 12 or remote from the printhead 12.

In an exemplary embodiment, the fluid supply container 14 discretely holds desired volumes of black ink, cyan ink, magenta ink, and yellow ink. In this regard, and in order to simplify the description, reference will be made to inks and ink jet printheads. However, the disclosed embodiment is adaptable to other micro-fluid ejecting devices other than for use in ink jet printers and thus is not intended to be limited to ink jet printers.

The printhead 12 preferably contains a nozzle plate 16 with a plurality of nozzle holes 18 each of which are in fluid flow communication with the fluids in the supply container 14. The nozzle plate 16 is preferably made of an ink resistant, durable material such as polyimide and is attached to a semiconductor substrate 20 that contains ink ejection devices as described in more detail below. The semiconductor substrate 20 is preferably a silicon semiconductor substrate.

Ejection devices on the semiconductor substrate 20 are activated by providing an electrical signal from a controller to the printhead 12. The controller is preferably provided in a device to which the supply container 14 is attached. The semiconductor substrate 20 is electrically coupled to a flexible circuit or TAB circuit 22 using a TAB bonder or wires to connect electrical traces 24 on the flexible or TAB circuit 22 with connection pads on the semiconductor substrate 20. Contact pads 26 on the flexible circuit or TAB circuit 22 provide electrical connection to the controller in the printer for activating the printhead 12.

The flexible circuit or TAB circuit 22 is preferably attached to the supply container 14 using a heat activated or pressure sensitive adhesive. Exemplary pressure sensitive adhesives include, but are not limited to phenolic butyral adhesives, acrylic based pressure sensitive adhesives such as AEROSET 1848 available from Ashland Chemicals of Ashland, Ky. and phenolic blend adhesives such as SCOTCH WELD 583 available from 3M Corporation of St. Paul, Minn.

During a fluid ejection operation such as printing with an ink, an electrical impulse is provided from the controller to activate one or more of the ink ejection devices on the printhead 12 thereby forcing fluid through the nozzles holes 18 toward a media such as paper. Fluid is caused to refill ink chambers in the printhead 12 by capillary action between ejector activation. The fluid flows from the fluid supplies in the container 14 to the printhead 12.

Figure 2:
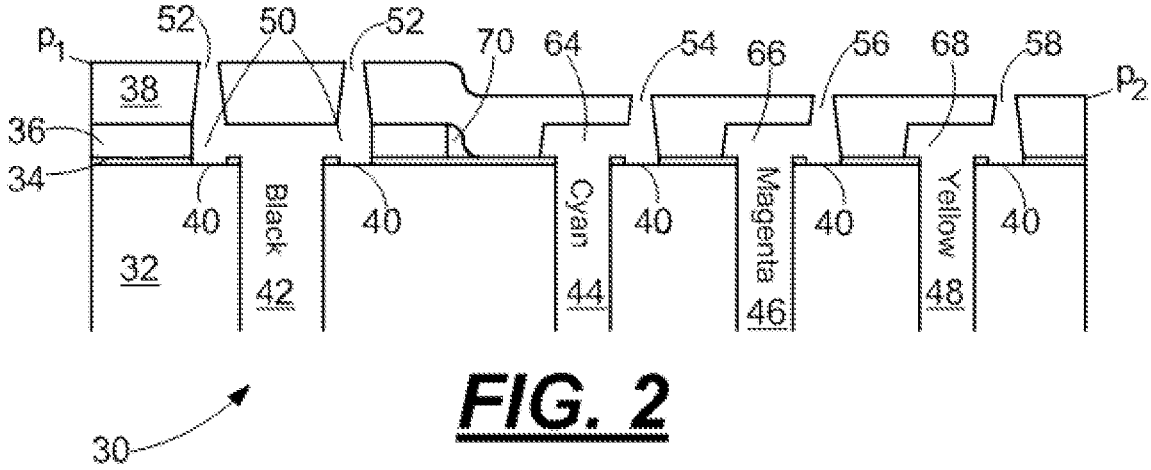
FIG. 2 is a cross-sectional side view of a printhead according to an exemplary embodiment of the disclosure.
Figure 3:
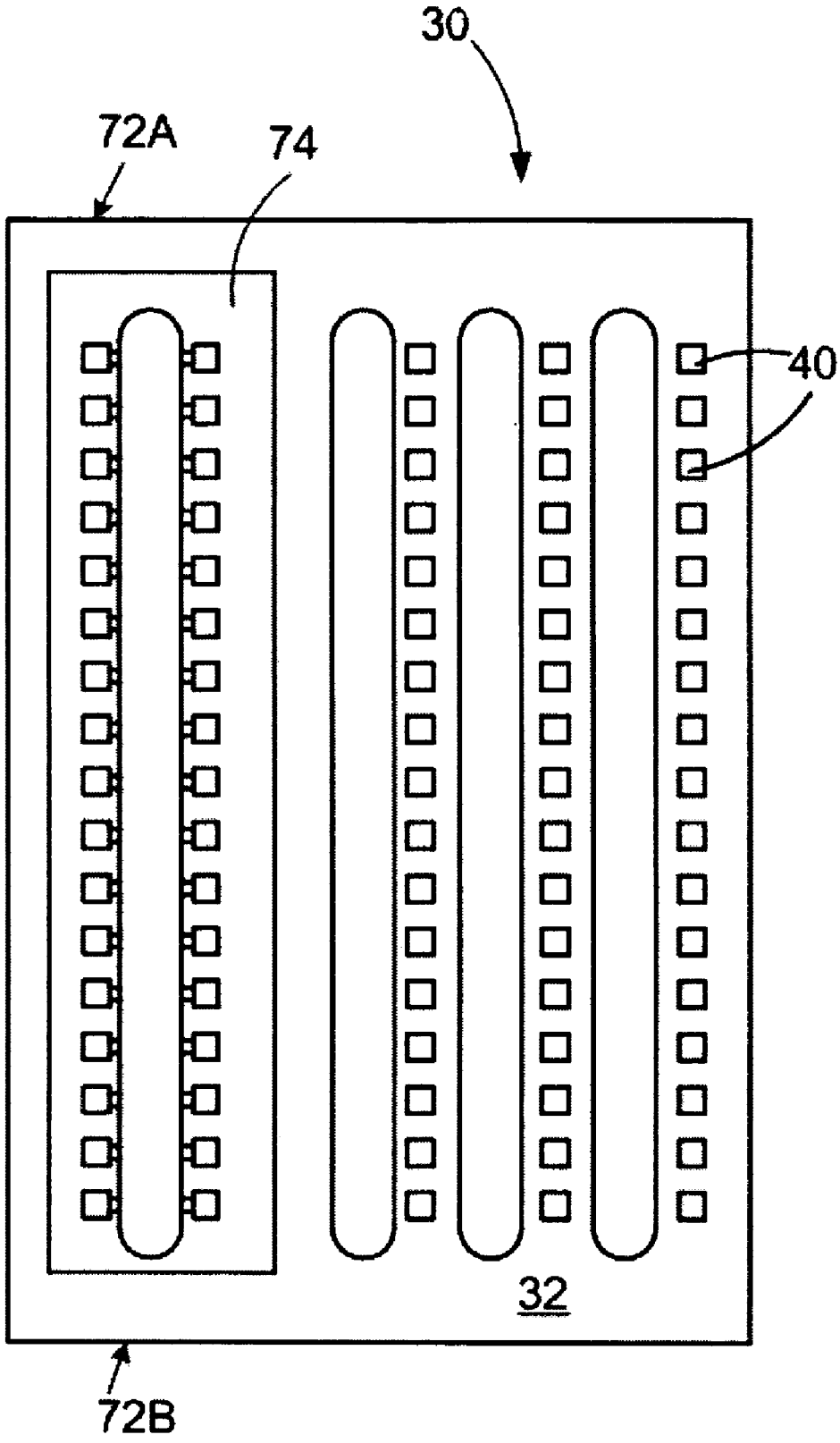
FIG. 3 is a top view of the printhead of FIG. 2, shown with the nozzle plate removed.

Turning now to FIGS. 2 and 3, various aspects of the embodiments will now be described. A printhead 30, according to the one embodiment, is configured to provide at least two different sets of flow features to provide at least two different volumes of inks. In an exemplary embodiment, one of the sets of flow features is provided for discharging black ink and the other set is provided for discharging colored ink. The flow features for discharging black ink are preferably sized to provide ink drop volumes of from about 15 to about 35 ng. The flow features for discharging colored inks are preferably sized to provide ink drop volumes of from about 1 to about 8 ng.

The term "flow features" refers to ink chambers and ink supply channels that provide a fluid such as ink to ejection devices on the semiconductor substrate for ejection through nozzle holes. In this regard, the printhead 30 preferably includes a semiconductor substrate 32, a first photoresist layer 34, a second photoresist layer 36, and a nozzle plate 38.

The semiconductor substrate 32, preferably a silicon substrate, is conventional in construction and includes ink ejection devices such as heaters 40, piezoelectric devices, or the like defined thereon. A plurality of ink supply channels 42, 44, 46, and 48 are formed in the substrate 32, as by deep reactive ion etching (DRIE), to define supply paths for the travel of ink from a fluid source, such as the fluid supply container 14 described above. In this regard, the supply channel 42 is configured for flow of black ink and the supply channels 44–48 are configured for flow of colored inks, such as cyan, magenta, and yellow inks. Accordingly, the channel 42 is preferably of larger dimension than the channels 44–48, with each of the channels dimensioned corresponding to provide a desired volume of ink to be flowed and ejected.

The first photoresist layer 34 is applied to the substrate 32, as by spin coating, and is patterned so that the heaters 40 are exposed. The layer 34 is preferably relatively thin, e.g., from about 1 to about 5 μm thick, and is provided to protect the substrate 32 from the corrosive effects of ink exposure and to improve adhesion of the substrate 32 to the nozzle plate 38.

The second photoresist layer 36 is a thick film layer having a thickness of from about 5 to about 20 microns and is applied, as by spin coating, and patterned so that the heaters 40 are exposed and ink flow features 50 are formed only at locations of the substrate 32 dedicated to ejection of black ink. That is, the flow features 50 are in flow communication with the supply channel 42, and are not in supply communication with the supply channels 44–48. The second photoresist layer 36 is preferably removed and is not present at the remaining portions of the substrate 32, and particularly those locations associated with the supply channels 44–48 dedicated to ejection of the colored inks. The flow features 50 are configured for providing, via the nozzles 52, black ink drops in the range of from about 15–35 ng.

The nozzle plate 38 is preferably made of polyimide and may be formed as by laser ablation. The nozzle plate 38 includes a plurality of pre-formed nozzles 52, 54, 56, and 58 for ejecting ink, and are associated with the channels 42–48, respectively. That is, the nozzles 52, which have openings in a first plane, p1, eject black ink supplied via the channel 42, and the nozzles 54–58, which have openings in a second plane, p2, supply colored ink supplied via the channels 44–48, respectively. A first portion of the nozzle plate 38 includes flow features 64, 66, and 68 preferably formed by laser ablating the nozzle plate material prior to attaching the nozzle plate 38 to the substrate 32. The flow features 64, 66, and 68 are associated with the supply channels 44–48 and the nozzles 54–58, respectively, for ejection of the colored inks. In this regard, the flow features 54–58 are each preferably sized for enabling colored ink drops of from about 1 to about 8 ng to be ejected via the nozzles 54–58. As will be appreciated, the portion of the nozzle plate 38 associated with the nozzles 52 and overlying the second photoresist layer 36 may be void of flow features, with the flow features for the ejection of the black ink flowing therethrough being provided by the flow features 50 defined only in the thick film layer 36. In an alternative embodiment, the flow features 50 for nozzles 52 may be partially formed in the thick film layer 36 and in the nozzle plate 38.

The nozzle plate 38, as shown in FIG. 2, has a substantially uniform thickness ranging from about 25 to about 70 microns. Typically, the nozzle plate material has a thickness of 25.4 microns, 27.9 microns, 38.1 microns, or 63.5 microns. Of the total thickness of the nozzle plate material, about 2.5 to about 12.7 microns is comprised of an adhesive layer that is applied by the manufacturer to the nozzle plate material. It will be understood however, that a nozzle plate material may be provided absent the adhesive layer. In this case, an adhesive is applied separately to attach the nozzle plate 38 to the thick film layer 36.

As will be seen, the nozzle plate 38 deforms at interface 70 between the portion of the printhead having the second photoresist layer 36 (dedicated to the ejection of black ink) and the adjacent portion of the printhead where the second layer 36 has been removed or not provided (dedicated to ejection of colored inks). The area of the interface 70 underneath the nozzle plate 38 defines a void area. While the first layer 34 provides a protective layer for the substrate 32, it has been observed that the void area of the interface 70 may preferably be sealed, as by dispensing a UV or thermally curable adhesive therein at either end of the void area, to inhibit entry of ink therein to further protect conductive, insulative, and resistive layers on the substrate 32 against corrosion.

In addition, and with reference to FIG. 3, the printhead 30 may further be protected from corrosion in the vicinity of the interface 70 as by patterning the second layer 36 so that it does not extend all the way to ends 72A and 72B of the semiconductor substrate 32 and the layer 36 defines an island structure 74. The nozzle plate 38 is able to deform adjacent the ends 72A and 72B and thus seal access to the void area 70.

As will be appreciated, the printhead 30 provides a printhead structure having a single semiconductor substrate and a single nozzle plate, yet which is able to supply black ink and colored inks in desired and different drops sizes.

Turning now to FIGS. 4–13, there are shown alternate, non-limiting, embodiments of printhead structures having a single semiconductor substrate 100 (including associated ejection devices such as heaters and the like) and suitable for supplying black ink and colored inks in the desired and different drops sizes.

The semiconductor substrate 100 is shown having two ink supply channels 102 and 104. The channel 102 is configured for flowing black ink and the channel 104 is configured for flowing a colored ink. The channel 102 corresponds to the channel 42 and the channel 104 corresponds to the channel 44 as described above.

It will be understood that the semiconductor 100 may further include additional channels, such as channels corresponding to the channels 46 and 48 described above. However, for the sake of simplicity, the embodiment is described with respect to only two of the channels. Thus, for example, if three colored inks are to be dispensed, then the portion corresponding to the dispensing of the colored ink would be similarly expanded to include additional ink supply channels and nozzles for the other colored inks. In addition, it will be understood that the semiconductor substrate 100 preferably includes ejection devices, such as the heaters 40, and typical associated circuitry layers, planarization, passivation layers and the like, such as the first photoresist layer 34 described above.

The printheads may further include a photoresist layer 106 corresponding to the second photoresist layer 36 which may be configured, as by laser ablation, to include flow features. The printheads further include a first nozzle plate 108, 141, 151 or 155 and, in some embodiments (FIGS. 8–10 and 12–13), a second nozzle plate 110 or 153. The nozzle plates 108, 110, 141, 151, 153 and 155 are preferably made of polyimide and may be formed as by laser ablation. As described below, the nozzle plates include pre-formed nozzles 112 and 114 for ejecting ink, and corresponding in location to the channels 102 and 104, respectively. That is, the nozzles 112, which have openings in a first plane, p1, eject black ink supplied via the channel 102, and the nozzles 114, which have openings in a second plane, p2, supply colored ink supplied via the channel 104 (plus any other similar channels for other colored inks), respectively. In addition and as described below, flow features may further be included on the nozzle plate or plates.

Figure 4:
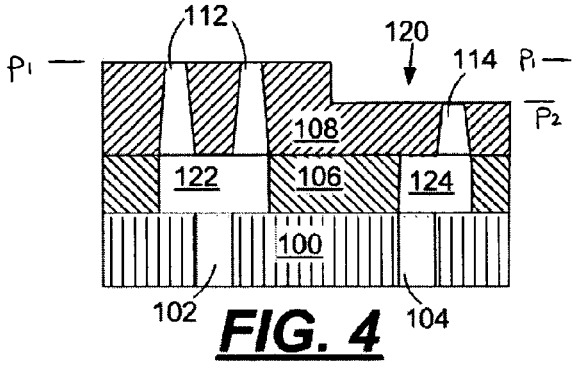
FIGS. 4–13 are cross-sectional side views printheads according to alternate embodiments of the disclosure.

With reference to FIG. 4, there is shown a printhead 120 including the substrate 100 with the channels 102 and 104, the photoresist layer 106, and the nozzle plate 108 having the nozzles 112 and 114. The photoresist layer 106 includes flow features 122 and 124 formed therein. In addition, a portion of the nozzle plate 108 associated with the nozzles 114 is reduced in thickness, as by laser ablation, etching, or dry etching, e.g., RIE or DRIE, so that the bore length of the nozzles 114 is reduced as compared to the bore length of the nozzle 112. The reduction in thickness may range from about 10 to about 80 percent of the total thickness of the nozzle plate 108. Thus, the printhead 120 utilizes a single semiconductor substrate 100 yet includes flow features 122 and the nozzles 112 configured for providing black ink drops in the range of from about 15–35 ng in conjunction with flow features 124 and nozzles 114 for providing colored ink drops of from about 1 to about 8 ng.

Figure 5:
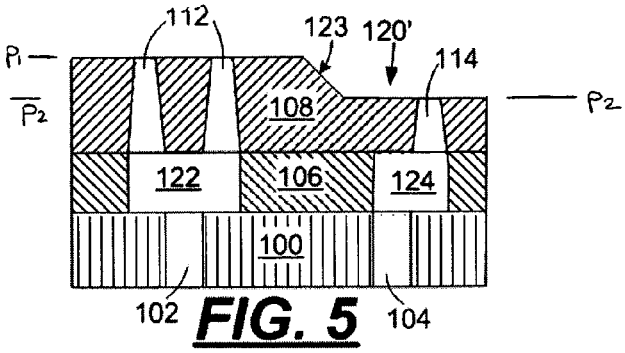

Turning now to FIG. 5, there is shown a printhead 120' that is identical to the printhead 120, except that the reduction in thickness of the nozzle plate is performed as by grayscale laser ablation so that the transition 123 from the thicker portion of the nozzle plate adjacent the nozzles 112 to the thinner portion adjacent the nozzles 114 is sloped to facilitate wiping features for cleaning the nozzle plate 108.

Figure 6:
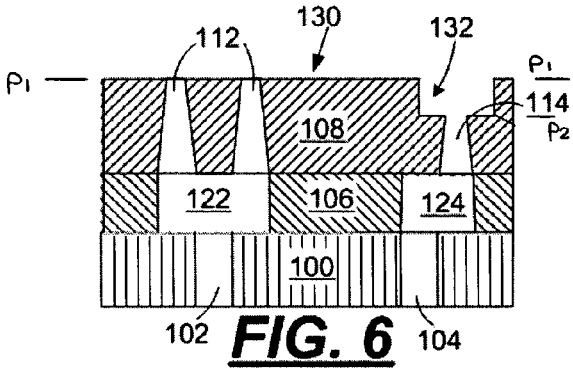

With reference to FIG. 6, there is shown a printhead 130 including the substrate 100 with the channels 102 and 104, the photoresist layer 106, and a single thickness nozzle plate 131 having the nozzles 112 and 114. The photoresist layer 106 includes flow features 122 and 124 formed therein. In addition, the portion of the nozzle plate 131 associated with the nozzles 114 has a channel 132 formed therein, as by etching, in the area adjacent the nozzles 114, so that the bore length of the nozzles 114 is reduced as compared to the bore length of the nozzle 112. The bore length of nozzles 114 preferably ranges from about 10 to about 80 percent of the bore length of nozzles 112. Thus, the printhead 130 utilizes a single semiconductor substrate yet includes flow features 122 and the nozzles 112 configured for providing black ink drops in the range of from about 15–35 ng in conjunction with flow features 124 and nozzles 114 for providing colored ink drops of from about 1 to about 8 ng.

Figure 7:
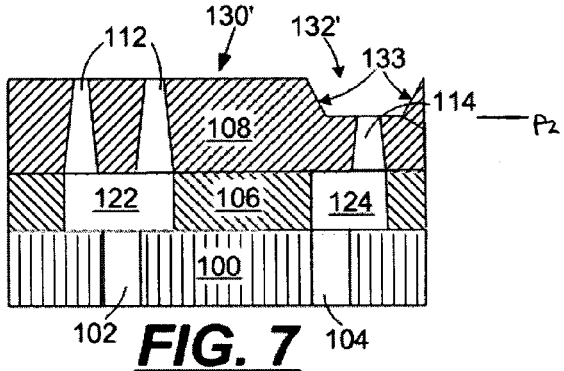

Turning now to FIG. 7, there is shown a printhead 130' that is identical to the printhead 130, except that formation of channel 132' is performed as by grayscale laser ablation so that the transition from the thicker portion adjacent the nozzles 112 to the channel 132' adjacent the nozzles 114 has sloped walls 133 to facilitate wiping features.

Figure 8:
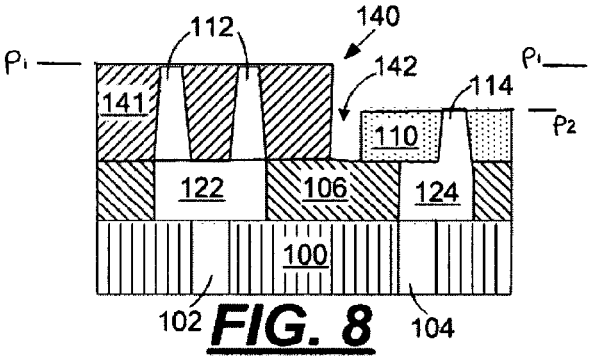

FIG. 8 shows a printhead 140 including the substrate 100 with the channels 102 and 104, the photoresist layer 106, and a nozzle plate 141 having the nozzles 112 and the nozzle plate 110 having the nozzles 114. The photoresist layer 106 includes flow features 122 and 124 formed therein. As will be noticed, the nozzle plate 110 is thinner than the nozzle plate 141 such that the bore length of the nozzles 114 is reduced as compared to the bore length of the nozzle 112. Accordingly, nozzle plate 110 may have a thickness that is about 10 to about 80 percent of the thickness of nozzle plate 141. If desired, void 142 between the nozzle plates 108*b* and 110 may be filled with a sealant or adhesive or the like to smooth the transition therebetween, as may be advantageous for facilitating wiping steps. Accordingly, it will be appreciated that the printhead 140 represents yet a further embodiment that utilizes a single semiconductor substrate 100 yet includes flow features 122 and the nozzles 112 configured for providing black ink drops in the range of from about 15–35 ng in conjunction with flow features 124 and nozzles 114 for providing colored ink drops of from about 1 to about 8 ng.

Figure 9:
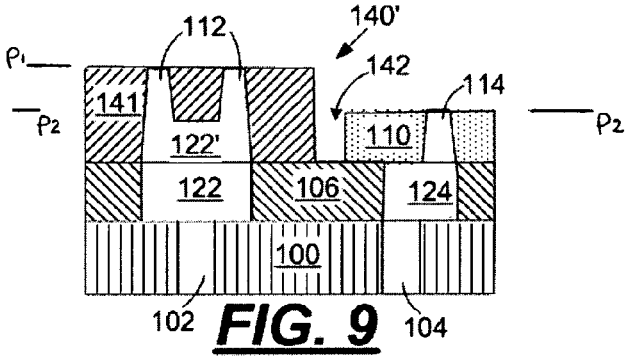

FIG. 9 shows a printhead 140' that is identical to the printhead 140, except that a nozzle plate 141 has been further ablated to provide additional flow features 122'. The modification of nozzle plate 141 to provide flow features 122' may also be used for the nozzle plates illustrated in FIGS. 4–7 and 10–13.

Figure 10:
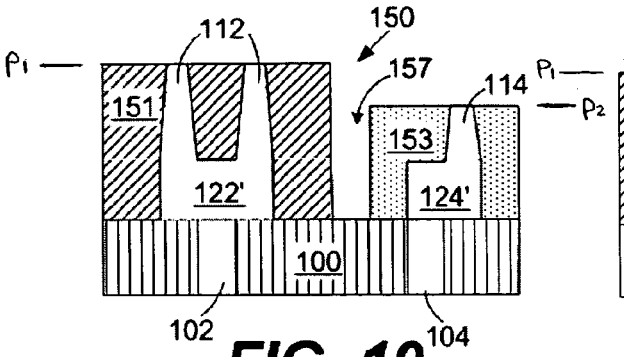

FIG. 10 shows a printhead 150 which does not include the photoresist layer 106. In this regard, the printhead 150 includes the substrate 100 with the channels 102 and 104 and a nozzle plate 151 having the nozzles 112 and a nozzle plate 153 having the nozzles 114. In this embodiment, the flow features are formed in the nozzle plates, e.g., flow features 122' and 124'. The nozzle plate 153 is from about 30 to about 60 percent thinner than the nozzle plate 151 such that the bore length of the nozzles 114 is reduced as compared to the bore length of the nozzle 112. A void 157 between the nozzle plates 151 and 153 may be filled with a sealant or adhesive or the like to smooth the transition therebetween, as may be advantageous for facilitating wiping steps. Accordingly, it will be appreciated that the printhead 150 represents yet a further embodiment that utilizes a single semiconductor substrate 100 yet includes the flow features 122' and the nozzles 112 configured for providing black ink drops in the range of from about 15–35 ng in conjunction with flow features 124' and nozzles 114 for providing colored ink drops of from about 1 to about 8 ng.

Figure 11:
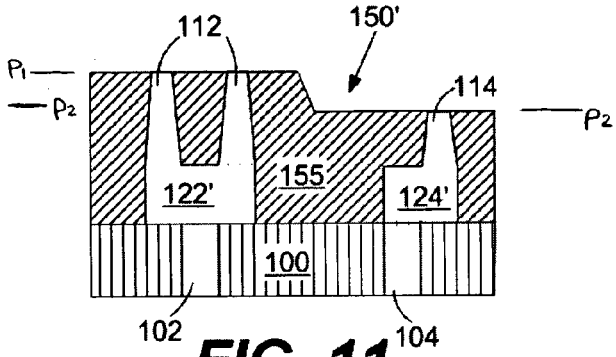

FIG. 11 shows a printhead 150' that includes a single nozzle plate 155 material, with the nozzles 114 and flow features 124' formed therein as described with reference to FIG. 10. In this embodiment, gray scale laser ablation is used to provide a reduction in nozzle plate thickness for nozzle hole 114.

Figure 12:
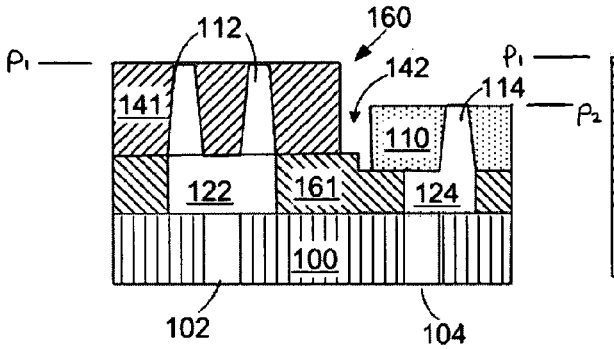

With reference to FIG. 12, there is shown a printhead 160 including the substrate 100 with the channels 102 and 104, a photoresist layer 161, the nozzle plate 141 having the nozzles 112, and the nozzle plate 110 having the nozzles 114. The photoresist layer 161 includes the flow features 122 and 124 formed therein, but with the thickness of the layer 161 associated with the flow feature 124 and the nozzle plate 110 being from about 10 to about 80 percent thinner than the portion of the layer 161 associated with the flow feature 122 and the nozzle plate 141. The nozzle plate 110 is also preferably from about 25 to about 35 percent thinner than the nozzle plate 141, so that the bore length of the nozzles 114 is reduced as compared to the bore length of the nozzle 112. However, the nozzle plate 110 could be of other thicknesses, with the flow features 124 and nozzles 114 cooperating to provide the reduced drop volume associated with color inks. Likewise, the flow features 122 and the nozzles 112 cooperate to provide the increased drop volume associated with black ink. Thus, the printhead 160 utilizes a single semiconductor substrate 100 yet includes the flow features 122 and the nozzles 112 configured for providing black ink drops in the range of from about 15–35 ng in conjunction with the flow features 124 and the nozzles 114 for providing colored ink drops of from about 1 to about 8 ng.

Figure 13:
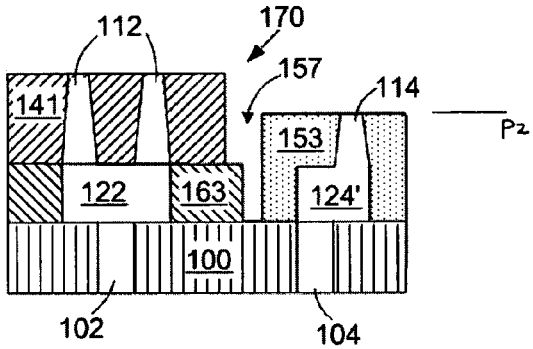

FIG. 13 shows a printhead 170 including the substrate 100 with the channels 102 and 104, a photoresist layer 163, the nozzle plate 141 having the nozzles 112, and the nozzle plate 153 having the nozzles 114. The photoresist layer 163 is present only on the portion of the substrate 100 adjacent the channel 102 and the nozzle plate 141 and includes the flow features 122. The nozzle plate 153 includes the flow features 124' formed thereon. The void 157 may be filled as described above.

The flow features 124' and nozzles 114 are preferably sized to provide the reduced drop volume associated with color inks and the flow features 122 and the nozzles 112 cooperate to provide the increased drop volume associated with black ink. Thus, the printhead 170 utilizes a single semiconductor substrate 100 yet includes the flow features 122 and the nozzles 112 configured for providing black ink drops in the range of from about 15–35 ng in conjunction with the flow features 124' and the nozzles 114 for providing colored ink drops of from about 1 to about 8 ng.

It will be appreciated that the flow feature height or depth for nozzle 114 does not have to be identical to the flow feature height or depth for nozzles 112 in FIGS. 10–11 and 13. Also, with respect to FIG. 13, a photoresist layer, such as layer 163, may be associated with nozzle plate 153 rather than with nozzle plate 141. Furthermore, it will be appreciated that more than two different drop sizes may be provided on a single ejection head by providing flow feature heights or depths corresponding to each desired drop size.

Having described various aspects and embodiments of the disclosure and several advantages thereof, it will be recognized by those of ordinary skills that the disclosed embodiments are susceptible to various modifications, substitutions and revisions within the spirit and scope of the appended claims.

What is claimed is:

1. An ink jet printhead, comprising a single substantially planar substrate with heaters on the substrate; first flow features having a first thickness in a height direction substantially perpendicular to the substrate and comprising first ink chambers and first ink supply channels for supplying ink to first selected ones of the heaters; second flow features having a second thickness in the height direction that is different from the first thickness and comprising second ink chambers and second ink supply channels for supplying ink to second selected ones of the heaters; and a nozzle plate, wherein the first flow features and second flow features are adjacent to the single substantially planar substrate, and wherein the nozzle plate has first ink ejection nozzles for ejecting first ink drops each having a first volume and second ink ejection nozzles for ejecting second ink drops each having a second volume different from the first volume, wherein the first volumes are defined by the first flow features and the second volumes are defined by the second flow features.

2. The ink jet printhead of claim 1 wherein at least a portion of the first flow features are defined on the nozzle plate.

3. The ink jet printhead of claim 1 wherein at least a portion of the second flow features are defined on the nozzle plate.

4. The ink jet printhead of claim 1 wherein the first volume is from about 15–35 nanograms.

5. The ink jet printhead of claim 1 wherein the second volume is from about 1–8 nanograms.

6. The ink jet printhead of claim 1, further comprising a photoresist layer located between at least portions of the substrate and the nozzle plate, the photoresist layer defining at least portions of the first flow features, or the second flow features, or both for receiving ink associated with the first ink drops, or the second ink drops, or both.

7. The ink jet printhead of claim 1, wherein the nozzle plate comprises a single nozzle plate.

8. The ink jet printhead of claim 1, wherein the nozzle plate comprises a first nozzle plate for ejecting the first ink drops and a second nozzle plate for ejecting the second ink drops.

9. The ink jet printhead of claim 1, wherein the first ink drops comprise black ink drops and the second ink drops comprise colored ink drops having a color selected from the group consisting essentially of cyan, magenta, and yellow.

10. A method for manufacturing an ink jet printhead to provide a printhead having a substrate for supplying ink in different desired drops sizes, the method comprising: providing a single substantially planar substrate with heaters on the single substrate and locating a nozzle plate adjacent to the single substrate, the nozzle plate with first ink ejection nozzles for ejecting first ink drops having a first volume and second ink ejection nozzles for ejecting second ink drops having a second volume different from the first volume, wherein the first volume is defined by first flow features of the printhead having a first thickness in a height direction substantially perpendicular to the substrate and the second volume is defined by second flow features having a second thickness in the height direction that is different from the first thickness.

11. The method of claim 10, wherein the first ink drops comprise drops of black ink and the second ink drops comprise drops of ink of a color selected from the group consisting of cyan, magenta, and yellow.

12. The method of claim 10, wherein at least a portion of the first flow features are defined on the nozzle plate.

13. The method of claim 10, wherein at least a portion of the second flow features are defined on the nozzle plate.

14. The method of claim 10, wherein the first volume is from about 15–35 nanograms.

15. The method of claim 10, wherein the second volume is from about 1–8 nanograms.

16. The method of claim 10, further comprising providing a photoresist layer between at least portions of the substrate and the nozzle plate and patterning the photoresist layer to define the first flow features, or the second flow features, or both for receiving ink associated with the first ink drops, or the second ink drops, or both.

17. The method of claim 10, wherein the step of providing a nozzle plate comprises providing a single nozzle plate.

18. The method of claim 10, wherein the step of providing a nozzle plate comprises providing a first nozzle plate for ejecting the first ink drops and a second nozzle plate for ejecting the second ink drops.

19. An inkjet printhead comprising a single substrate with heaters on the single substrate;a first plurality of nozzles, each having an exit opening substantially in a first plane substantially parallel with a plane defined by a device surface of the single substrate; a second plurality of nozzles, each having an exit opening substantially in a second plane substantially parallel with the plane defined by the device surface, wherein the first plane and second plane are substantially non-coplanar.

20. The inkjet printhead of claim 19, wherein flow features associated with the first plurality of nozzles have a different thickness in a height direction substantially perpendicular to the substrate than flow features associated with the second plurality of nozzles.

21. The inkjet printhead of claim 19, wherein the nozzles are comprised in a nozzle plate with a nozzle exit surface having multiple heights.

22. The inkjet printhead of claim 21, wherein the nozzle plate comprises at least two nozzle plates, wherein at least one of the at least two nozzle plates has surface with a height that is different from a height of a surface of at least one of the other at least two nozzle plates.

* * * * *